US008331590B2

(12) United States Patent
Yamakawa et al.

(10) Patent No.: US 8,331,590 B2
(45) Date of Patent: Dec. 11, 2012

(54) DELAY TIME CALCULATION APPARATUS AND METHOD

(75) Inventors: Takashi Yamakawa, Iwata (JP); Koji Kushida, Hamamatsu (JP)

(73) Assignee: Yamaha Corporation (JP)

( * ) Notice: Subject to any disclaimer, the term of this patent is extended or adjusted under 35 U.S.C. 154(b) by 284 days.

(21) Appl. No.: 12/612,332

(22) Filed: Nov. 4, 2009

(65) Prior Publication Data

US 2010/0111311 A1 May 6, 2010

(30) Foreign Application Priority Data

Nov. 4, 2008 (JP) ..... 2008-283003

(51) Int. Cl.
*H04R 5/02* (2006.01)
*H04R 5/00* (2006.01)

(52) U.S. Cl. ..... 381/303; 381/304; 381/17; 381/18

(58) Field of Classification Search ..... 381/17–19, 381/58–59, 77, 92, 300, 303–304, 97
See application file for complete search history.

(56) References Cited

FOREIGN PATENT DOCUMENTS

JP 2006-211230 A 8/2006

*Primary Examiner* — Devona Faulk
*Assistant Examiner* — George Monikang
(74) *Attorney, Agent, or Firm* — Rossi, Kimms & McDowell LLP

(57) ABSTRACT

A delay time calculation apparatus enabling all the speaker units of a delay array type speaker array to contribute to formation of a combined wavefront. Sound receiving points for acoustic waves output from the speaker units are set within a target area for the acoustic waves. For each speaker unit, an average value of differences between distances between the sound receiving points for the speaker units and other speaker units and distances between the sound receiving points for the speaker units and the speaker units is determined, and an average value of differences between distances from the other speaker units to sound receiving points for the other speaker units and distances from the speaker units to the sound receiving points for the other speaker units is determined. An average of the average values is converted into a delay time, thereby determining the delay time for each speaker unit.

2 Claims, 7 Drawing Sheets

FIG. 8A
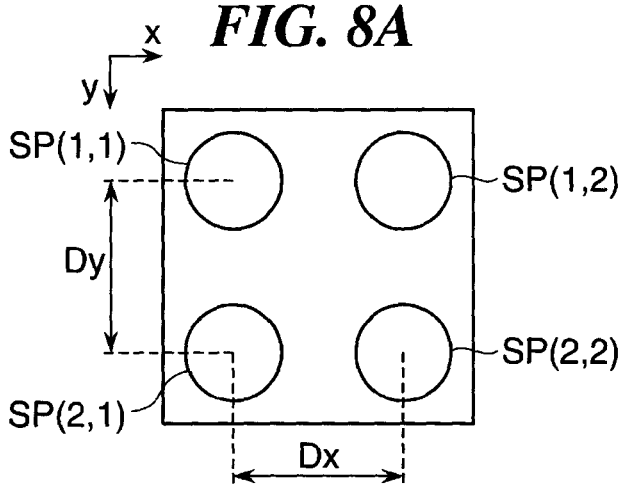
FIG. 8B
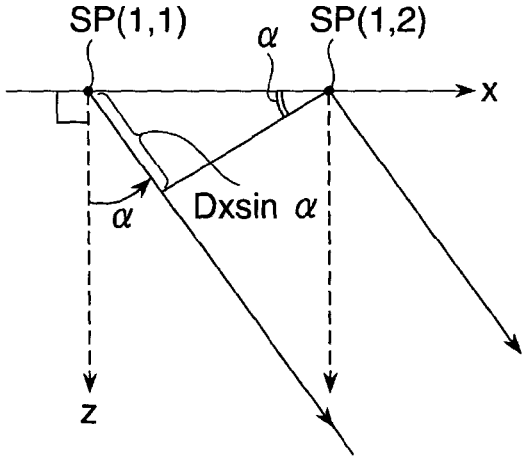
FIG. 8C
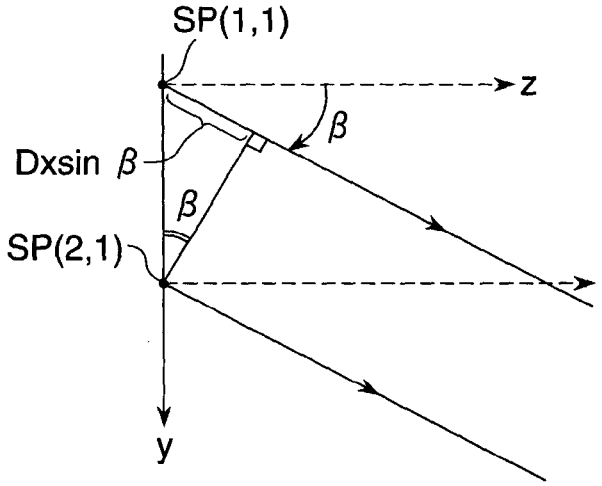
FIG. 8D
| SP(1,1) | SP(1,2) |
|---|---|
| 0 | $\frac{D}{C\sqrt{2}}$ |
| SP(2,1) | SP(2,2) |
| $\frac{D}{C\sqrt{2}}$ | $\frac{2D}{C\sqrt{2}}$ |

DELAY TIME CALCULATION APPARATUS AND METHOD

BACKGROUND OF THE INVENTION

1. Field of the Invention

The present invention relates to a technique for controlling directivity of a speaker array comprised of speaker units, and more particularly, to a delay time calculation apparatus and method for achieving directivity control by adjusting differences between delay times in supplying an input audio signal to speaker units.

2. Description of the Related Art

As a speaker array system, a delay array type speaker array system is known (see, for example, Japanese Laid-open Patent Publication No. 2006-211230). In a delay array type speaker array system, delay times of audio signals supplied to speaker units of a speaker array are adjusted for control of directivity of acoustic waves output from the speaker array. The directivity control is to control the propagating direction and the spread of a combined wavefront of acoustic waves output from the speaker units. Delay times are time differences from when an audio signal output from an acoustic source is received by the speaker array system to when the audio signal is supplied to the speaker units.

In the directivity control disclosed in Japanese Laid-open Patent Publication No. 2006-211230, first delay processing for horizontal control is performed on an input audio signal IN10 to generate n first delayed audio signals corresponding to respective ones of speaker unit columns SP(i, 1), SP(i, 2), . . . SP(i, n) (i=1 to m). Next, second delay processing for vertical control is performed on respective ones of the n first delayed audio signals to obtain n×m second delayed audio signals, which are supplied to the speaker units SP(i, j) (i=1 to m, and j=1 to n).

In an example technique to specify the propagating direction of a combined wavefront, the propagating direction is specified by vertical and horizontal steering angles. Assuming that a direction normal to an array plane of the speaker array is z axis, a vertical direction is y axis, and a horizontal direction perpendicular to the z and y axes is x axis, the propagating direction of the combined wavefront is specified by rotation angles from the z axis to the x axis and from the z axis to the y axis (horizontal and vertical steering angles). In that case, the propagating direction of the combined wavefront can be represented by $\alpha$ and $\beta$ degrees by which the combined wavefront is steered leftward in the horizontal direction and downward in the vertical direction, thus making it easy to intuitively understand the propagation direction.

In the case of, e.g., a speaker array having four speaker units SP(i, j) (i=1 to 2, j=1 to 2) arranged in two rows and two columns in the horizontal and vertical directions as shown in FIG. 8A, if the horizontal and vertical steering angles $\alpha$, $\beta$ are specified as shown in FIGS. 8B and 8C, a combined wavefront propagating in the direction represented by the two steering angles $\alpha$, $\beta$ can be generated by controlling delay time differences between audio signals supplied to the speaker units SP (i, j), as described below.

For speaker units disposed adjacently in the horizontal direction (e.g., speaker units SP (1, 1) and SP (1, 2)), audio signals are supplied that have a delay time difference corresponding to a difference between paths of acoustic waves output from these speaker units. For example, with reference to the audio signal for the speaker unit SP (1, 1) (i.e., assuming that the delay time for the speaker unit SP(1, 1) is equal to zero), the delay time for the speaker unit SP(1, 2) is determined to have a value corresponding to a path difference Dx sin $\alpha$ (see FIG. 8B) relative to the speaker unit SP(1, 1). Specifically, the delay time is obtained by dividing the path difference by the sound velocity.

Similarly, for speaker units (e.g., SP(1, 1) and SP(2, 1)) disposed adjacently in the vertical direction, the delay time for the speaker unit SP(2, 1) is determined to have a value corresponding to a path difference Dy sin $\beta$ (see FIG. 8C) relative to the speaker unit SP(1, 1). Since the speaker unit SP(2, 2) has path differences of Dy sin $\beta$ and Dx sin $\alpha$ relative to the speaker units SP(1, 2) and SP(1, 1), the delay time for the speaker unit SP(2, 2) is determined to have a value corresponding to the sum of the path differences (Dx sin $\alpha$+Dy sin $\beta$).

With the directivity control in which the propagating direction of a combined wavefront is specified by horizontal and vertical steering angles and delays corresponding to path differences shown in FIGS. 8B and 8C are given, the delay time becomes excessively larger for speaker units which are disposed closer to the corners of the speaker array. As a result, a problem is posed that acoustic waves output from these speaker units do not effectively contribute to the formation of the combined wavefront.

For example, in a case that relations of Dx=Dy=D and $\alpha=\beta=45$ degrees are satisfied in the speaker array in FIG. 8A and the sound velocity is represented by C, the delay times for the speaker units SP(i, j) relative to the speaker unit SP(1, 1) are determined as shown in FIG. 8D. It is apparent from FIG. 8D that the delay time for the speaker unit SP(2, 2) becomes excessively large as compared to those for the speaker units SP(1, 2) and SP(2, 1).

SUMMARY OF THE INVENTION

The present invention provides delay time calculation apparatus and method for delay array type directivity control of a speaker array, which are capable of preventing delay time for some speaker unit of the speaker array from being excessively large, to thereby enable all the speaker units to contribute to formation of a combined wavefront.

According to a first aspect of this invention, there is provided a delay time calculation apparatus comprising a setting unit configured to set sound receiving points within a target area, the sound receiving points and the target area being target arrival points and a target emission region for acoustic waves output from speaker units of a speaker array, and a delay time calculation unit configured to calculate delay times for the speaker units from when an input audio signal is received by the delay time calculation unit to when the input audio signal is supplied to the speaker units, the delay time calculation unit being configured to determine for each of the speaker units an average value of differences between distances between the sound receiving points for the speaker units and other speaker units other than each of the speaker units and distances between the sound receiving points for the speaker units and the speaker units, determine for each of the speaker units an average value of differences between distances from the other speaker units to sound receiving points for the other speaker units and distances from the speaker units to the sound receiving points for the other speaker units, and convert an average of both the average values for each of the speaker units into the delay time for each of the speaker units.

According to a second aspect of this invention, there is provided a delay time calculation method comprising a setting step of setting sound receiving points within a target area, the sound receiving points and the target area being target arrival points and a target emission region for acoustic waves output from speaker units of a speaker array, and a delay time calculation step of calculating delay times for the speaker units from when an input audio signal is received to when the input audio signal is supplied to the speaker units, the delay time calculation step including determining for each of the speaker units an average value of differences between distances between the sound receiving points for the speaker units and other speaker units other than each of the speaker units and distances between the sound receiving points for the speaker units and the speaker units, determining for each of the speaker units an average value of differences between distances from the other speaker units to sound receiving points for the other speaker units and distances from the speaker units to sound receiving points for the other speaker units, and converting an average of both the average values for each of the speaker units into the delay time for each of the speaker units.

Further features of the present invention will become apparent from the following description of an exemplary embodiment with reference to the attached drawings.

BRIEF DESCRIPTION OF THE DRAWINGS

FIGS. 8A to 8D are views for explaining an example of directivity control by a conventional delay array type speaker array system.

DETAILED DESCRIPTION OF THE PREFERRED EMBODIMENT

The present invention will now be described in detail below with reference to the drawings showing a preferred embodiment thereof.

Figure 1:
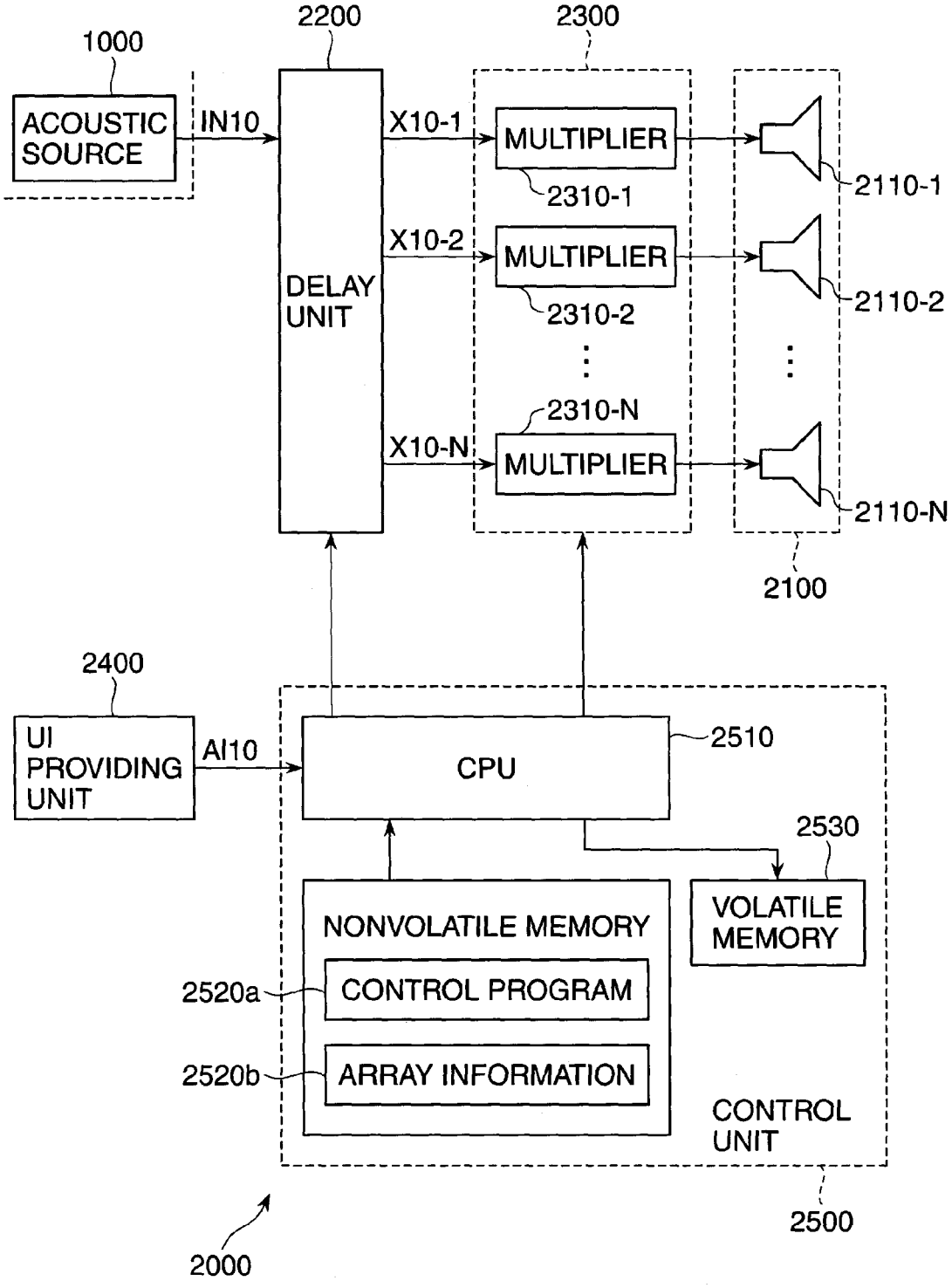
FIG. 1 is a view showing the construction of a speaker array system according to one embodiment of this invention.

FIG. 1 shows an example construction of a speaker array system 2000 that includes a delay time calculation apparatus according to one embodiment of this invention. As shown in FIG. 1, the speaker array system 2000 includes a speaker array 2100, a delay unit 2200, an amplification unit 2300, a user interface providing unit (hereinafter referred to as the UI providing unit) 2400, and a control unit 2500.

The speaker array 2100 includes speaker units 2110-*i* (i=1 to N, where N represents a natural number not less than 2). The speaker units 2110-*i* are arranged such that speaker axes extend parallel to one another (i.e., a planer baffle surface is formed). With the speaker array system 2000, a combined wavefront propagating in a certain propagating direction is formed by an envelope of wavefronts, at the same point of time, of acoustic waves output from the speaker units 2110-*i*. The speaker array system 2000 is configured to realize directivity control by adjusting delay times in supplying an input audio signal IN10 from an acoustic source 1000 to the speaker units 2110-*i*. In other words, the speaker array system 2000 is a so-called delay array type speaker array system.

Cone speakers or other speakers having wide directivity can be used as the speaker units 2110-*i*. The speaker array 2100 can be constructed by speaker units having the same acoustic characteristic as one another or a combination of plural types of speaker units which are different from one another in acoustic characteristic (e.g., output frequency range).

Figure 2A:
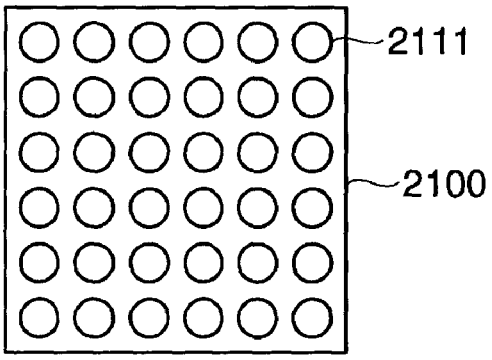
FIGS. 2A and 2B are views each showing an example arrangement of speaker units in a speaker array of the speaker array system.
Figure 2B:
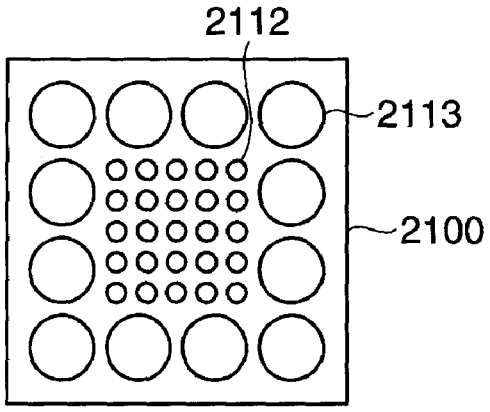

In a case that the speaker array 2100 consists of speaker units having the same acoustic characteristic, the speaker units 2111 are arranged in a matrix, as shown in FIG. 2A. On the other hand, in a case that the speaker array 2100 is comprised of a combination of plural types of speaker units having different acoustic characteristics, small-sized speaker units 2112 for high-frequency range are arranged in a matrix and large-sized speaker units 2113 for low-frequency range are arranged to surround the small-sized speaker units 2112, as shown in FIG. 2B. In the latter case, it is preferable that reproduction frequency bands of the speaker units should at least partly overlap one another.

The delay unit 2200 is, e.g., a DSP (digital signal processor). The delay unit 2200 performs delay processing on the input audio signal IN10 supplied from the acoustic source 1000 to thereby generate delayed audio signals X10-*i* (i=1 to N) for the speaker units 2110-*i*. In a case that the input audio signal IN10 is an analog signal, the analog signal is converted into a digital signal by an A/D converter (not shown) before being supplied to the delay unit 2200.

In this embodiment, so-called one-tap delay processing is implemented as the delay processing. The one-tap delay processing can be implemented by use of shift registers or a RAM (random access memory). For example, in the case of using a RAM, the delay unit 2200 performs processing to write the input audio signal IN10 into the RAM and read out the input audio signal IN10 from the RAM upon elapse of time periods corresponding to the delay times for the speaker units 2110-*i*, thereby obtaining the delayed audio signals X10-*i* to be supplied to the amplification unit 2300. With this embodiment in which the delay processing is achieved by the one-tap delay processing, the delay unit 2200 can be constituted by a smaller scale DSP than in a case where FIR (finite impulse response) type delay processing is carried out.

The amplification unit 2300 includes multipliers 2310-*i* (i=1 to N) that correspond to respective ones of the speaker units 2110-*i*. The multipliers 2310-*i* are supplied with the delayed audio signals X10-*i* from the delay unit 2200, and multiply the delayed audio signals X10-*i* by predetermined coefficients supplied from the control unit 2500, thereby amplifying the delayed audio signals X10-*i* to a level suited to drive the speaker units. The delayed audio signals X10-*i* output from the amplification unit 2300 are converted into analog audio signals by D/A converters (not shown in FIG. 1) and supplied to respective ones of the speaker units 2110-*i*. In a case that shading processing is performed to suppress sidelobe, the multipliers 2310-*i* subject the delayed audio signals X10-*i* to window function processing using a rectangular or hanning window.

The UI providing unit 2400 includes a display device and an input device (e.g., a liquid crystal display and a mouse), and is used by a user to input information for use in the calculation of delay times. As the information for the delay time calculation, there are array information and area information. The array information represents spatial positions of the speaker units 2110-*i*.

There are various types of array information. For example, position coordinates of the speaker units 2110-*i* in a three dimensional coordinate system defined in a three dimensional space where the speaker array 2100 is disposed can be used as the array information. In that case, the position coordinates of all the speaker units 2110-*i* of the speaker array 2100 are input by the user.

It is also possible to use, as the array information, relative position information representing relative positions of the speaker units 2110-*i* relative to the center of the array plane, a position coordinate of the center of the array plane in the three dimensional space, and components of the normal vector of the array plane. In that case, the relative position information is written into a nonvolatile memory 2520 of the control unit 2500 in advance at shipment from factory, whereas the position coordinate of the center of the array plane and the components of the normal vector of the array plane are input by the user via the UI providing unit 2400.

On the other hand, the area information is information representing the position, shape, and size of a target area. The target area is a target emission region for acoustic waves output from the speaker array 2100. As shown in FIG. 1, the UI providing unit 2400 supplies the control unit 2500 with area information AI10 representing the target area, which is set by the user.

The control unit 2500 executes a directivity control process in which delay times for the speaker units 2110-*i* are calculated based on the array information and the area information AI10, and the calculated delay times are supplied to the delay unit 2200 for the directivity control. As shown in FIG. 1, the control unit 2500 includes a CPU (central processing unit) 2510, a nonvolatile memory 2520 (e.g., a flash ROM), and a volatile memory 2530 (e.g., a RAM). The nonvolatile memory 2520 stores the array information 2520*b* and stores in advance a control program 2520*a* in accordance with which CPU 2510 executes the directivity control process. The volatile memory 2530 is utilized by the CPU 2510 as a work area at execution of the control program 2520*a*.

Next, a description is given of the directivity control process executed by the CPU 2510 of the control unit 2500 in accordance with the control program 2520*a*.

Figure 3:
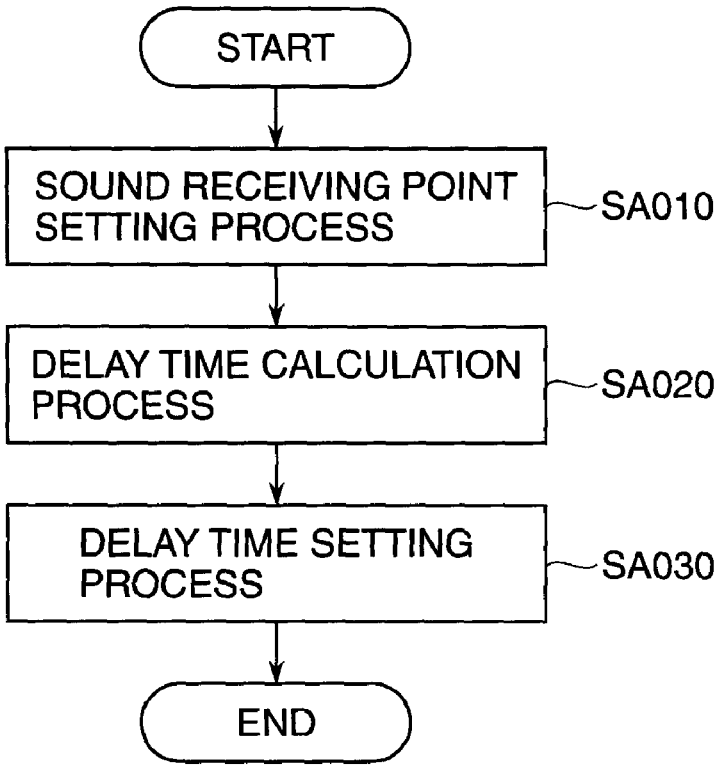
FIG. 3 is a view showing an example of a directivity control process executed by a CPU of a control unit of the speaker array system.

FIG. 3 shows in flowchart the flow of the directivity control process. The directivity control process in this embodiment includes three processes, i.e., a sound receiving point setting process (step SA010), a delay time calculation process for calculating delay times for the speaker units 2100-*i* (i=1 to N) by using sound receiving points set in step SA010 (step SA020), and a delay time setting process for setting the delay times calculated in step SA020 to the delay unit 2200 (step SA030).

Among these processes, the delay time setting process in step SA030 is not so much different from a conventional one, and concrete contents of the delay time setting process can be determined according to whether the delay unit 2200 is implemented by shift registers or a RAM. In the following, therefore, the processes in steps SA010 and SA020 by which this embodiment is characterized will be described in detail.

Figure 4A:
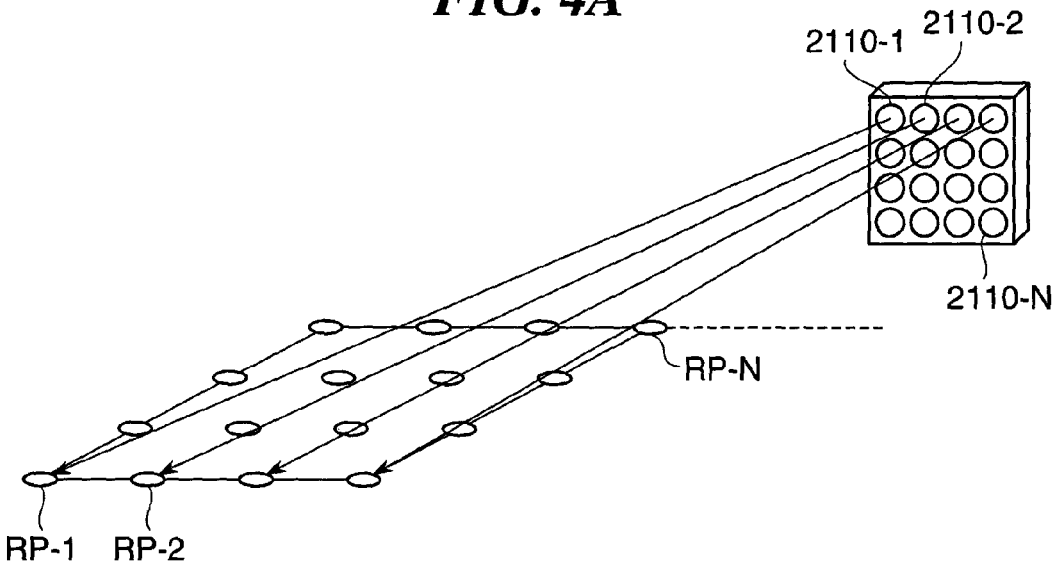
FIGS. 4A to 4C are views for explaining how sound receiving points corresponding to the speaker units are set.

The sound receiving point setting process in step SA010 is a process to set sound receiving points for the speaker units 2110-*i*. The sound receiving points are target arrival points within a target area for acoustic waves output from the speaker units 2110-*i*. In the following, the content of the process in step SA010 is described for an example where the speaker array 2100 has an array plane on which speaker units are arranged in a matrix as shown in FIG. 2A, and the target area represented by the area information AI10 has a rectangular shape having sides thereof extending parallel to horizontal sides of the array plane (see FIG. 4A).

In step SA010, processing to determine a projection image of the array plane projected onto the target area is executed. In this process, vectors $P_{ui}$ represented by the following formula (A) are each subjected to an affine transformation represented by a matrix T (which is represented by the following formula (B)). In other words, products $TP_{ui}$ are calculated. The vectors $P_{ui}$ include respective ones of position coordinates ($ax_i$, $ay_i$, $az_i$) of the speaker units 2110-*i* in an xyz coordinate system whose coordinate origin is at the center of the array plane and whose x, y, and z axes extend in the normal, vertical, and horizontal directions of the array plane (see FIG. 4B).

Figure 4B:
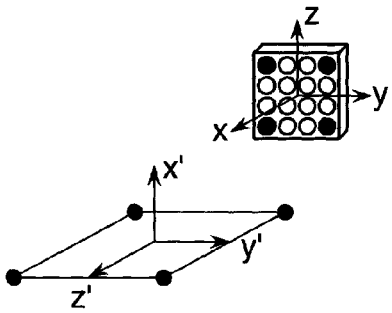

In formula (B), $O_{ax}$, $O_{ay}$ and $O_{az}$ are x', y' and z' coordinates of the center of the target area in an x'y'z' coordinate system whose x' axis extends in the normal direction of the target area, y' axis extends the normal direction of the array plane of the speaker array 2100, and z' axis extends perpendicular to the x' and z' axes as shown in FIG. 4B. In formula (B), $vZ_x$, $vZ_y$ and $vZ_z$ are x', y' and z' axis components of the z-axis unit vector in FIG. 4B. Similarly, $vY_x$, $vY_y$ and $vY_z$ are x', y' and z' axis components of the y-axis unit vector, and $vX_x$, $vX_y$ and $vX_z$ are x', y' and z' axis components of the x-axis unit vector.

$$Pui = \begin{bmatrix} ax_i \\ ay_i \\ az_i \\ 1 \end{bmatrix} \tag{A}$$

$$T = \begin{bmatrix} vX_x & vY_x & vZ_x & O_{ax} \\ vX_y & vY_y & vZ_y & O_{ay} \\ vX_z & vY_z & vZ_z & O_{az} \\ 0 & 0 & 0 & 1 \end{bmatrix} \tag{B}$$

Figure 4C:
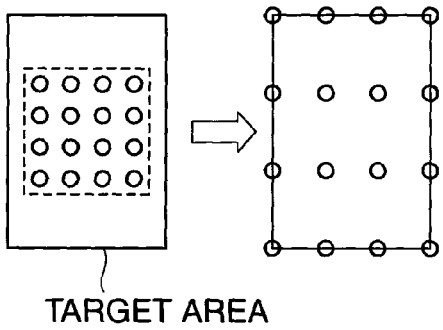

Next, in the sound receiving point setting process in step SA010, edit processing is executed to expand or contract, with a constant ratio of expansion and contraction, the projection image of the array plane obtained by the affine transformation so as to cover the target area in just proportion as shown in FIG. 4C, and projection points after edit processing are set as the sound receiving points. In this example, to cover the target area in just proportion by the projection image of the array plane, the projection image is expanded so that outermost speaker units on the array plane of the speaker array 2100 are positioned on the outer periphery of the target area. Hereinafter, the sound receiving points, obtained by subjecting the position coordinates of the speaker units 2110-*i* to the affine transformation and the edit processing, will be referred to as the sound receiving points RP-i.

The delay time calculation process (step SA020) is a process to calculate delay times for the speaker units 2110-*i* based on distances between the speaker units 2110-*i* and the sound receiving points RP-i. To enable all the speaker units to contribute to the formation of a combined wavefront, it is preferable that the delay times for the speaker units 2110-*i* be determined such that each of acoustic waves output from the speaker units 2110-*i* reaches the corresponding sound receiving point RP-i earlier than acoustic waves output from the other speaker units 2110-*j* (j≠i). Hereinafter, a condition to enable each of acoustic waves output from the speaker units 2110-*i* to reach the corresponding sound receiving point RP-i earlier than acoustic waves output from the other speaker units 2110-*j* (j≠i) will be referred to as the earliest-reaching condition.

The earliest-reaching condition is represented by the following formula (1), in which $r_{ii}$ represents distances between the speaker units 2110-*i* and the sound receiving points RP-i, $r_{ji}$ represents distances between the other speaker units 2110-*j* (j≠i) and the sound receiving points RP-i, $\Delta t_i$ represents the delay times for the speaker units 2110-*i*, $\Delta t_j$ represents the delay times for the other speaker units 2110-*j* (j≠i), and c represents the sound velocity.

$$r_{ii}+c\Delta t_i \leqq r_{ji}+c\Delta t_j \tag{1}$$

In a case that the speaker array 2100 is comprised of N speaker units, the earliest-reaching condition is represented by N×(N−1) simultaneous inequalities. For example, in a case that the speaker array 2100 is comprised of four speaker units, the delay times $\Delta t_i$ (i=1 to 4) that satisfy the earliest-reaching condition are determined by solving the following twelve simultaneous inequalities (2-1) to (2-12).

$$r_{11}+c\Delta t_1 \leqq r_{21}+c\Delta t_2 \tag{2-1}$$

$$r_{11}+c\Delta t_1 \leqq r_{31}+c\Delta t_3 \tag{2-2}$$

$$r_{11}+c\Delta t_1 \leqq r_{41}+c\Delta t_4 \tag{2-3}$$

$$r_{22}+c\Delta t_2 \leqq r_{12}+c\Delta t_1 \tag{2-4}$$

$$r_{22}+c\Delta t_2 \leqq r_{32}+c\Delta t_3 \tag{2-5}$$

$$r_{22}+c\Delta t_2 \leqq r_{42}+c\Delta t_4 \tag{2-6}$$

$$r_{33}+c\Delta t_3 \leqq r_{13}+c\Delta t_1 \tag{2-7}$$

$$r_{33}+c\Delta t_3 \leqq r_{23}+c\Delta t_2 \tag{2-8}$$

$$r_{33}+c\Delta t_3 \leqq r_{43}+c\Delta t_4 \tag{2-9}$$

$$r_{44}+c\Delta t_4 \leqq r_{14}+c\Delta t_1 \tag{2-10}$$

$$r_{44}+c\Delta t_4 \leqq r_{24}+c\Delta t_2 \tag{2-11}$$

$$r_{44}+c\Delta t_4 \leqq r_{34}+c\Delta t_3 \tag{2-12}$$

In general, however, convergent calculations involving a large number of repetitive calculations must be made to solve simultaneous inequalities. Besides, a solution of the simultaneous inequalities cannot always be found. This embodiment is characterized in that instead of strictly solving the simultaneous inequalities representing the earliest-reaching condition, distance-related values $d_i$ are calculated according to the following formula (C) and converted by distance-time conversion (i.e., division by the sound velocity c) into delay times, thereby determining the delay times for the speaker units 2110-*i* (i=1 to N).

In formula (C), $q_{ji}=(a_{ji}+b_{ji})/2$, $a_{ji}=r_{jj}-r_{ij}$, and $b_{ji}=r_{ji}-r_{ii}$, where j≠i. To calculate the values $d_i$ in formula (C), calculations according to formula (D) are implemented. To prevent any of the delay times for the speaker units 2110-*i* from having a negative value, the delay times for the speaker units 2110-*i* can be obtained by dividing values of $d_i-d_{min}$ by the sound velocity c, where $d_{min}$ represents a minimum value of the values $d_i$ calculated according to formula (C).

$$d_i = \frac{\sum_{j=1(j\neq i)}^{N} q_{ji}}{N-1} \tag{C}$$

$$d_i = \frac{1}{2}\left\{\frac{\sum_{j=1(j\neq i)}^{N} a_{ji}}{N-1} + \frac{\sum_{j=1(j\neq i)}^{N} b_{ji}}{N-1}\right\} \tag{D}$$

In formula (D), $a_{ji}$ represents differences between distances $r_{jj}$ from the speaker units 2110-*j* to the sound receiving points RP-j and distances $r_{ij}$ from the speaker units 2110-*i* to the sound receiving points RP-j, and $b_{ji}$ represents differences between distances $r_{ji}$ from the speaker units 2110-*j* to the sound receiving points RP-i and distances $r_{ii}$ from the speaker units 2110-*i* to the sound receiving points RP-i. To determine the delay time for each speaker unit 2110-*i* by the distance-time conversion of the distance-related value $d_i$ calculated according to formula (D) is therefore just to determine an arithmetic average of the differences between distances $r_{jj}$ and distances $r_{ij}$ and an arithmetic average of the differences between distances $r_{ji}$ and distances $r_{ii}$ for each suffix j (j=1 to N, and j≠i) and convert an arithmetic average of both the average values into the delay time for the speaker unit 2110-*i* by distance-time conversion. If the sound receiving points RP-i for the speaker units 2110-*i* are set, values of the right side of formula (D) can be determined without implementing convergent calculations. It is therefore possible to determine the values $d_i$ of formula (D) with a less number of calculations, as compared to a case where the simultaneous inequalities representing the earliest-reaching condition are numerically solved.

In the following, the reason why valid delay times for the speakers units 2110-*i* can be determined by converting the values $d_i$ calculated according to formula (D) into delay times is described for an example where N=3, i.e., the speaker array 2110 consists of three speaker units 2110-*i*.

In the example where the speaker array 2100 consists of speaker units 2110-*i* (i=1 to 3), the earliest-reaching condition is represented by the following six simultaneous inequalities.

$$r_{11}+c\Delta t_1 \leqq r_{21}+c\Delta t_2 \tag{3-1}$$

$$r_{11}+c\Delta t_1 \leqq r_{31}+c\Delta t_3 \tag{3-2}$$

$$r_{22}+c\Delta t_2 \leqq r_{12}+c\Delta t_1 \tag{3-3}$$

$$r_{22}+c\Delta t_2 \leqq r_{32}+c\Delta t_3 \tag{3-4}$$

$$r_{33}+c\Delta t_3 \leqq r_{13}+c\Delta t_1 \tag{3-5}$$

$$r_{33}+c\Delta t_3 \leqq r_{23}+c\Delta t_2 \tag{3-6}$$

From formulae (3-1) and (3-3), the following inequality formula (4-1) can be obtained, where $\Delta t_{ij}=\Delta t_j-\Delta t_i$. Similarly, the following inequality formula (4-2) can be obtained from formulae (3-2) and (3-5), and inequality formulae (4-3) and (4-4) can be obtained from formulae (3-4) and (3-6).

$$r_{11}-r_{21} \leqq c\Delta t_{12} \leqq r_{12}-r_{22} \tag{4-1}$$

$$r_{11}-r_{31} \leqq c\Delta t_{13} \leqq r_{13}-r_{33} \tag{4-2}$$

$$r_{22}-r_{32} \leqq c\Delta t_{23} \leqq r_{23}-r_{33} \tag{4-3}$$

$$r_{33}-r_{23} \leqq c\Delta t_{32} \leqq r_{32}-r_{22} \tag{4-4}$$

Values $\Delta t_{ij}$ in formulae (4-1) to (4-4) are equal to the delay times $\Delta t_j$ for the speaker units 2110-*j* (j≠i) in a case that the delay calculation is implemented with reference to the speaker units 2110-*i* (i.e., if $\Delta t_i=0$). Formulae (4-1) to (4-4) can be represented by the following formula (5) by using the differences $a_{ij}$ $b_{ij}$.

$$a_{ij} \leqq c\Delta t_{ij} \leqq b_{ij} \tag{5}$$

Figure 5A:
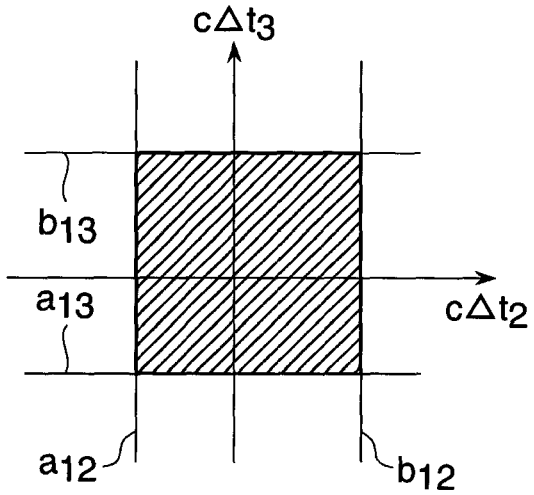
FIGS. 5A to 5D are views for explaining the reason why valid delay times for the speaker units can be calculated according to formula (C)
Figure 5B:
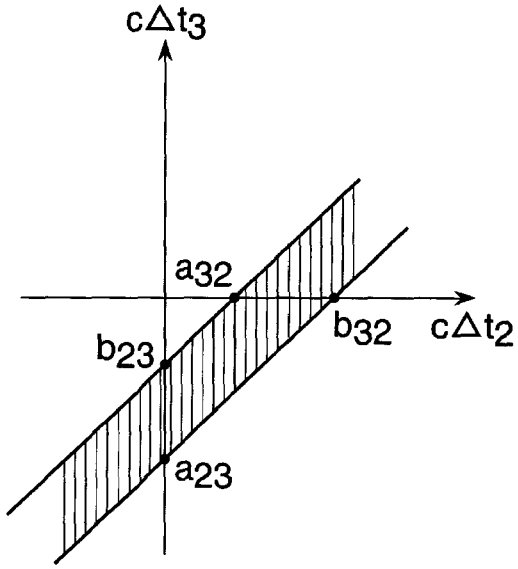

A hatched region in a ($c\Delta t_2$, $c\Delta t_3$) orthogonal coordinate system in FIG. 5A indicates a range of $c\Delta t_2$ and $c\Delta t_3$ that satisfies formulae (4-1) and (4-2) in a case that the delay calculation is implemented with reference to the speaker units 2110-*i* (i.e., if $\Delta t_1=0$). A hatched region in the ($c\Delta t_2$, $c\Delta t_3$)

orthogonal coordinate system in FIG. 5B indicates a range of $c\Delta t_2$ and $c\Delta t_3$ that satisfies formulae (4-3) and (4-4) irrespective of whether the delay calculation is implemented with reference to the speaker units 2110-*i*.

Figure 5C:
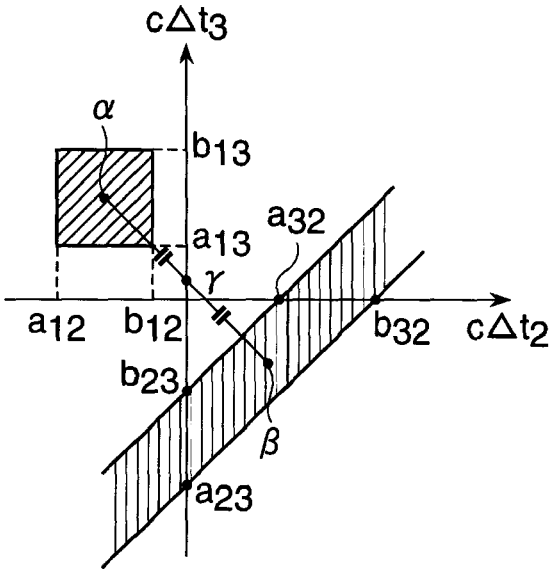
Figure 5D:
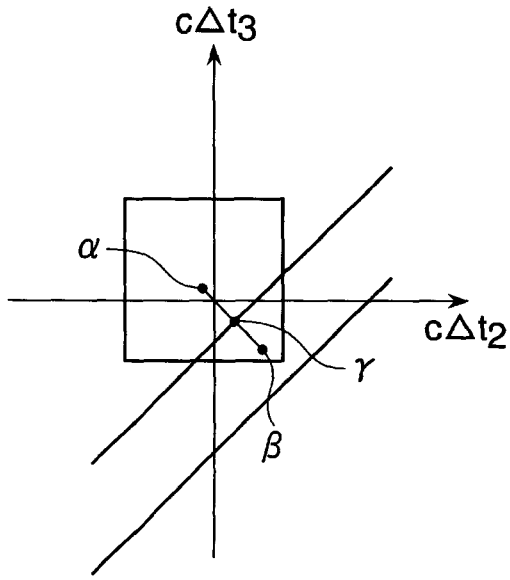

If the ranges of $c\Delta t_2$ and $c\Delta t_3$ in FIGS. 5A and 5B do not overlap each other as shown in FIG. 5C, there is no solution to the simultaneous inequalities given by formulae (4-1) to (4-4) under the condition of $\Delta t1=0$. On the other hand, if the ranges in FIGS. 5A and 5B overlap each other as shown in FIG. 5D, any combination of $c\Delta t_2$ and $c\Delta t_3$ both of which are within the overlap range is a solution to the simultaneous inequalities. In FIG. 5D, hatching for the range of $c\Delta t_2$ and $c\Delta t_3$ is omitted for the sake of clarity.

In FIGS. 5C and 5D, a point a indicates the center of gravity of the region represented by formulae (4-1) and (4-2) (e.g., the hatched region in FIG. 5A), and a point β indicates the center of gravity of a trapezoid whose apexes are represented by four coordinate points $(a_{32}, 0)$, $(0, b_{23})$, $(0, a_{23})$ and $(b_{32}, 0)$ that define the region represented by formulae (4-3) and (4-4) (e.g., the hatched region in FIG. 5B). Thus, the point a has a coordinate of $((a_{12}+b_{12})/2, (a_{13}+b_{13})/2)$, i.e., $(q_{12}, q_{13})$, and the point β has a coordinate of $((a_{32}+b_{32})/2, (a_{23}+b_{23})/2)$, i.e., $(q_{32}, q_{23})$. A point of γ in FIGS. 5C and 5D is the midpoint or the center of gravity of a line segment connecting the points α, β and having a coordinate of $((q_{12}+q_{32})/2, (q_{13}+q_{23})/2)$, i.e., $(d_2, d_3)$.

As apparent from FIG. 5D, if there are solutions to formulae (4-1) to (4-4) (i.e., if the hatched regions in FIGS. 5A and 5B overlap each other), it is ensured that the point γ is contained in the overlap region. In other words, if there exist solutions to formulae (4-1) to (4-4), it can be said that the values $d_2$, $d_3$ calculated according to formula (C) are solutions to formulae (4-1) to (4-4).

Even if there are no solutions to formulae (4-1) to (4-4), the point γ is located at the midpoint between the hatched regions in FIGS. 5A and 5B, as shown in FIG. 5C. The values $d_2$, $d_3$ calculated according to formula (C) are not solutions to the simultaneous inequalities given by formulae (4-1) to (4-4), but can be regarded as proper values since the values $d_2$, $d_3$ are not inclined toward either the condition represented by formulae (4-1), (4-2) or the condition represented by formulae (4-3), (4-4).

As described above, it is valid to use the values $d_i$ calculated according to formula (C) or (D) for the calculation of the delay times for the speaker units 2110-*i*.

It should be noted that formula (5) indicates ranges of delay times for the speaker units 2110-*j* that satisfy the earliest-reaching condition in a case that the delay calculation is implemented with reference to the speaker units 2110-*i* ($i \neq j$). In other words, the values $q_{ij}$ are center values of the ranges of delay times for the speaker units 2110-*j* that satisfy the earliest-reaching condition in a case that the delay calculation is implemented with reference to the speaker units 2110-*i*.

Considering the meaning of formula (C) based on the above description, it is understood that the values $d_i$ calculated according to formula (C) are each an arithmetic average of the center values of the ranges of delay times for the speaker units 2110-*i* that satisfy the earliest-reaching condition in a case that the delay calculation is implemented with reference to each of the speaker units 2110-*j* (j=1 to N, and $j \neq i$). The values $d_i$ calculated according to formula (C) can be said to have the just-mentioned meaning in the mathematical expression.

As described above, the delay times $d_i$ calculated according to formula (C) are valid not only in a case that there exist solutions to the simultaneous inequalities representing the earliest-reaching condition, but also in a case that there exist no solutions to the simultaneous inequalities. By using the values $d_i$ calculated according to formula (C), it is possible to prevent the delay times for speaker units located at corners of the speaker array from being excessively large. As a result, acoustic waves output from these speaker units can be prevented from not contributing to the formation of a combined wavefront at all.

With this embodiment, the number of calculations can be reduced as compared to a case where the simultaneous inequalities representing the earliest-reaching condition are numerically solved. In other words, proper delay times in supplying audio signals to the speaker units of the speaker array can be determined without implementing a large number of numeric calculations.

In the above, there has been described one embodiment of this invention, which may be modified variously as described below.

(First Modification)

In the embodiment, this invention is applied to a two-dimensional speaker array in which speaker units are arranged to form a planar baffle surface. However, the speaker array can, of course, be configured to have speaker units arranged to form a curved baffle surface.

(Second Modification)

In the embodiment, the rectangular target area is set. However, the target area can have any shape. It is enough to modify or expand or contract the projection image of the array plane obtained by affine transformation such as to cover the target area in just proportion.

Figure 6A:
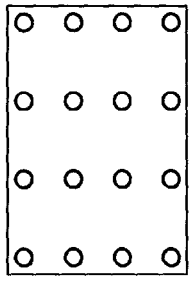
FIGS. 6A to 6E are views for explaining how sound receiving points are set in a second modification.

In the embodiment, the projection image is edited such that projection points of outermost speaker units 2110-*i* on the array plane of the speaker array 2100 are positioned on the outer periphery of the target area. However, it is enough to implement the edit process such that the projection points of the outermost speaker units 2110-*i* are not positioned beyond the target area, as shown in FIG. 6A.

Figure 6B:
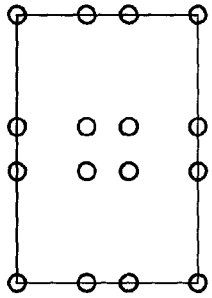
Figure 6C:
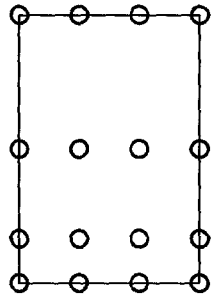
Figure 6C:
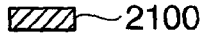

In the edit process of the embodiment, the projection image is expanded or contracted with a constant ratio of expansion and contraction, but the ratio of expansion and contraction is not required to be constant. For example, the ratio of expansion can be smaller toward the center of the target area and larger toward the ends of the target area as shown in FIG. 6B. Alternatively, the ratio of expansion can be smaller toward the speaker array 2100 and larger away from the speaker array 2100 as shown in FIG. 6C. Further alternatively, the ratio of expansion can be larger toward the speaker array and smaller away from the speaker array.

In the embodiment, the array plane of the speaker array 2100 is projected so as to overlap the target area set by the UI providing unit 2400, the projection image of the array plane is modified or expanded or contracted so as to cover the target area in just proportion, and the projection points in the edited projection image corresponding to the speaker units 2110-*i* are used as the sound receiving points. However, it is possible to set, via the UI providing unit 2400, the target area and the sound receiving points for the speaker units of the speaker array 2100 in the target area, and put the these sound receiving points and the speaker units 2110-*i* into one-to-one correspondence with one another. In that case, the speaker units 2110-*i* and the sound receiving points are corresponded such as to minimize the sum of linear distances from the speaker units 2110-*i* to the corresponding sound receiving points.

Figure 6D:
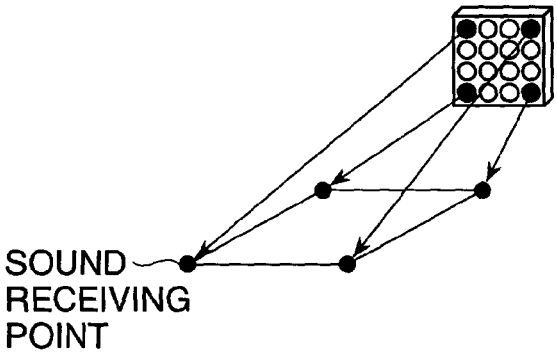
Figure 6E:
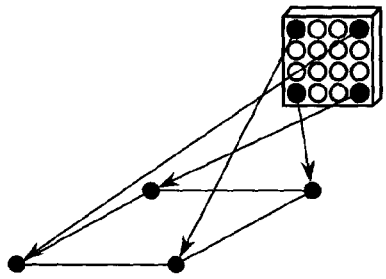

In a case for example that the speaker units 2110-*i* are arranged in a matrix and the target area has a rectangular shape as shown in FIG. 2A, speaker units located at four corners of the array plane must be corresponded to sound receiving points located at four corners of the target area as shown in FIG. 6D. If the speaker units are corresponded to the sound receiving points as shown in FIG. 6E, the delay times of delayed audio signals supplied to the speaker units 2110-*i* cannot be determined so as to satisfy the earliest-reaching condition. It should be noted that the embodiment apparently satisfies the requirement that the sum of linear distances from the speaker units 2110-*i* to the corresponding sound receiving points be minimized.

(Third Modification)

In the embodiment, an arithmetic average of differences $a_{ji}$ between distances $r_{jj}$ from the speaker units 2110-*j* to the sound receiving points RP-j and distances $r_{ij}$ from the speaker units 2110-*i* to the sound receiving points RP-j is calculated for each suffix j, an arithmetic average of differences $b_{ji}$ between distances $r_{ji}$ from the speaker units 2110-*j* to the sound receiving points RP-i and distances $r_{ji}$ from the speaker units 2110-*j* to the sound receiving points RP-i is calculated for each suffix j, and an average of both the average values is converted into the delay time for the corresponding speaker unit 2110-*i*. Alternatively, a geometric average or a weighted average of the differences $a_{ji}$ and $b_{ji}$ can be calculated for each suffix j instead of calculating the arithmetic average thereof, and an arithmetic average, an geometric average, or a weighted average of the geometric averages or weighted averages of the differences $a_{ji}$ and $b_{ji}$ can be converted into the delay time for the corresponding speaker unit 2110-*i*.

(Fourth Modification)

In the embodiment, the values $d_i$ calculated according to formula (D) are converted into the delay times of delayed audio signals supplied to the speaker units 2110-*i* (i=1 to N) of the speaker array 2100. In formula (D), suffix j (j=1 to N, and j≠i) denotes the remaining N−1 speaker units other than the speaker unit 2110-*i*. To calculate the delay time for, e.g., the i-th speaker unit 2110-*i* according to formula (D), an arithmetic average value of differences $r_{ji}-r_{ii}$, i.e., $b_{ji}$, between distances $r_{ji}$ between the sound receiving points RP-i and the speaker units 2110-*j* and distances $r_{ii}$ between the sound receiving points RP-i and the speaker units 2110-*i* is determined, and an arithmetic average value of differences $r_{jj}-r_{ij}$, i.e., $a_{ji}$, between distances $r_{jj}$ from the speaker units 2110-*j* to the sound receiving points RP-j and distances $r_{ij}$ from the speaker units 2110-*i* to the sound receiving points RP-j is determined. Then, an average of both the average values of the differences $a_{ji}$, $b_{ji}$ is converted into the delay time for the speaker unit 2110-*i*.

However, to calculate the delay time for the i-th speaker unit 2110-*i*, it is unnecessary to perform calculations on all of the N−1 speaker units 2110-*j* other than the i-th speaker unit 2110-*i*. For example, calculations on K (K<N−1) speaker units 2110-*j* selected from among the N−1 speaker units 2110-*j* can be performed according to formula (E) instead of according to formula (D), and the calculated value $d_i$ can be converted into the delay time for the speaker unit 2110-*i*.

To select K speaker units, there are various methods such as a random selection method utilizing pseudo random numbers, a method for selecting speaker units such that the selected speaker units are uniformly disposed on the array plane, and a method for selecting speaker units including ones disposed at four corners on the array plane. A value of K, i.e., the number of speaker units to be selected, can be determined by experiment, and different values of K can be used for different speaker units.

With the fourth modification, appropriate delay times of delayed audio signals supplied to speaker units can be calculated in a short time, even if the speaker array is comprised of a large number of speaker units.

$$d_i = \frac{1}{2}\left\{\frac{\sum_j^K a_{ji}}{K} + \frac{\sum_j^K b_{ji}}{K}\right\} \tag{E}$$

(Fifth Modification)

In the embodiment, instead of solving the simultaneous inequalities representing the earliest-reaching condition, the delay times of delayed audio signals supplied to the speaker units 2110-*i* are determined by performing the calculations according to formula (D) and converting the calculated values into the delay times. It is generally preferable that the delay times of delayed audio signals supplied to the speaker units 2110-*i* smoothly change between adjacent speaker units of the speaker array 2000. On the other hand, it is not ensured that the delay times obtained by the conversion of values calculated according to formula (D) smoothly change between adjacent speaker units. Thus, the delay times calculated to formula (D) can be subjected to smoothing.

As an example method for such smoothing, there is a method utilizing a weighted average. More specifically, to calculate the delay time for a given speaker unit 2110-*i*, values $d_i$ for the speaker unit 2110-*i* and M−1 peripheral speaker units are calculated according to formula (D). Next, as shown in the following formula (F), each of the calculated values $d_i$ (i.e., $d_{ij}$) is weighted by a weight $w_{ij}$ determined according to a distance $L_{ij}$ between the speaker units 2110-*i* and 2110-*j* on the array plane of the speaker array 2100, thereby calculating a weighted average value $d_{i'}$. Then, the calculated value $d_{i'}$ is converted into the delay time for the speaker unit 2110-*i*. It should be noted that in formula (F), $w_{ij}$ (j≠i) are reciprocals of the distances $L_{ij}$ between the speaker units 2110-*j* and 2110-*i* (i.e., $w_{ij}=1/L_{ij}$), and $w_{ii}$ are larger than M−1 other $w_{ij}$.

$$d_i' = \frac{\sum_j^M w_{ij} d_{ij}}{\sum_j^M w_{ij}} \tag{F}$$

Figure 7:
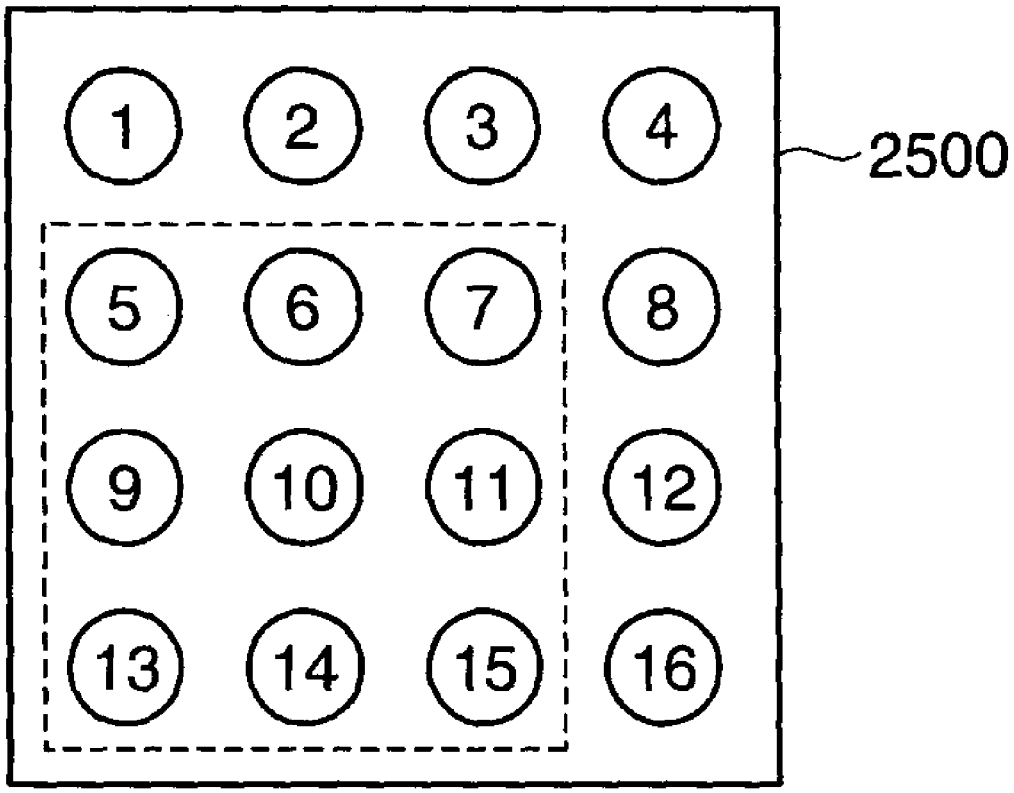
FIG. 7 is a view for explaining smoothing in a fifth modification.

In a case that the speaker array 2100 is comprised of 16 speaker units and M has a value of 9 as shown in FIG. 7, the delay time of the delayed audio signal supplied to, e.g., the speaker unit 2110-*i* (i=10) can be determined by converting into delay times the value di' calculated according to formula (F) based on values $d_{ij}$, i.e., values $d_i$ calculated according to formula (D) for the speaker units 2110-*j* (j=5, 6, 7, 9, 11, 13, and 14).

In the fifth modification, smoothing on the delay times of delayed audio signals supplied to speaker units is achieved by calculating weighted averages according to formula (F). However, in a case that speaker units are uniformly arranged on the speaker array, smoothing can be achieved by utilizing an LPF using a two-dimensional FIR filter, as with ordinary image processing.

(Sixth Modification)

In the embodiment, the UI providing unit 2400 and the control unit 2500 function as a setting unit for setting the target area, and the control unit 2500 functions as a delay time calculation unit for calculating delay times of delayed audio signals X10-*i* supplied to the speaker units 2110-*i*. However, it is possible to combine the setting unit and the delay time calculation unit so as to configure a delay time calculation apparatus suitable for delay time control of the delay array type speaker array.

(Other Modifications)

A control program for causing a computer apparatus to function as the setting unit and the delay time calculation unit (in the embodiment, the control program 2502*a*) may be stored for distribution in a CD-ROM (compact disk-read only memory) or other computer-readable recording medium, or may be downloaded for distribution via the Internet or other electronic communication line. The distributed control program may be stored into an ordinary computer apparatus and a CPU of the computer apparatus may be operated according to the control program, whereby the ordinary computer apparatus can be used as the delay time calculation apparatus.

What is claimed is:

1. A delay time calculation apparatus for a speaker array having N number of speaker units, where N is an integer greater than two, the apparatus comprising:

a setting unit configured to set N number of respective sound receiving points corresponding to the N number of speaker units within a target area, the sound receiving points and the target area respectively being target arrival points and a target emission region for acoustic waves output from the speaker units of the speaker array; and a control unit programmed to calculate delay times for each of the speaker units, between the control unit receiving an input audio signal and supplying the input audio signal to each of the speaker units, wherein the control unit is programmed to:

determine (a) a first average value of distance differences between:

(1) distances R(j,j) from each of non-target speaker units that are not currently targeted for calculation of the delay time, to the respective sound receiving point thereof, and (2) distances R(i,j) from one current target speaker unit for which the delay time is to be calculated to each of the sound receiving points corresponding to the non-target speaker units, based on an expression $\Sigma[R(j,j)-R(i,j)]/(N-1)$; and determine (b) a second average value of distance differences between:

(3) distances R(j,i) from each of the non-target speaker units to the one sound receiving point corresponding to the target speaker unit, and (4) distance R(i,i) from the target speaker unit to the respective sound receiving point, based on an expression $\Sigma[R(j,i)-R(i,i)]/(N-1)$, wherein i and j each represent an integer from 1 to N, and for each of i from 1 to N, j is incremented from 1 to N, but so that $j \neq i$, to calculate for each of the first and second average value of distance differences for each of the target speaker units;

determine for each of the target speaker units an average value of the first average value and the second average value; and convert the average of the first and second average values for each of the target speaker units into the delay time therefor.

2. A delay time calculation method for a delay time calculation apparatus for a speaker array having N number of speaker units, where N is an integer greater than two, the apparatus comprising a setting unit and a control unit, the method comprising:

a setting step of setting, with the setting unit, N number of respective sound receiving points corresponding to the N number of speaker units within a target area, the sound receiving points and the target area respectively being target arrival points and a target emission region for acoustic waves output from the speaker units of the speaker array; and a delay time calculation step of calculating, with the control unit, delay times for each of the speaker units, between the control unit receiving an input audio signal and supplying the input audio signal to each of the speaker units, by:

determining (a) a first average value of distance differences between:

(1) distances R(j,j) from each of non-target speaker units that is not currently targeted for calculation of the delay time, to the respective sound receiving point thereof, and (2) distances R(i,j) from one current target speaker unit for which the delay time is to be calculated to each of the sound receiving points corresponding to the non-target speaker units, based on an expression $\Sigma[R(j,j)-R(i,j)]/(N-1)$; and determining (b) a second average value of distance differences between:

(3) distances R(j,i) from each of the non-target speaker units to the one sound receiving point corresponding to the target speaker unit, and (4) distance R(i,i) from the target speaker unit to the respective sound receiving point, based on an expression $\Sigma[R(j,i)-R(i,i)]/(N-1)$, wherein i and j each represent an integer from 1 to N, and for each of i from 1 to N, j is incremented from 1 to N, but so that $j \neq i$, to calculate for each of the first and second average value of distance differences for each of the target speaker units;

determining for each of the target speaker units an average value of the first average value and the second average value; and converting the average of the first and second average values for each of the target speaker units into the delay time for each of the target speaker units.

* * * * *